US009672948B2

(12) United States Patent
Singh

(10) Patent No.: US 9,672,948 B2
(45) Date of Patent: Jun. 6, 2017

(54) CASK APPARATUS, SYSTEM AND METHOD FOR TRANSPORTING AND/OR STORING HIGH LEVEL WASTE

(75) Inventor: Krishna P. Singh, Jupiter, FL (US)

(73) Assignee: Holtec International, Inc.

( * ) Notice: Subject to any disclaimer, the term of this patent is extended or adjusted under 35 U.S.C. 154(b) by 1389 days.

(21) Appl. No.: 12/769,622

(22) Filed: Apr. 28, 2010

(65) Prior Publication Data

US 2010/0272225 A1 Oct. 28, 2010

Related U.S. Application Data

(60) Provisional application No. 61/173,392, filed on Apr. 28, 2009.

(51) Int. Cl.

| | |
|---|---|
| ***G21F 5/10*** | (2006.01) |
| ***G21F 5/12*** | (2006.01) |
| *G21F 5/005* | (2006.01) |

(52) U.S. Cl.

CPC ..... *G21F 5/10* (2013.01); *G21F 5/12* (2013.01); *G21F 5/005* (2013.01)

(58) Field of Classification Search

USPC ..... 376/272; 588/16

See application file for complete search history.

(56) References Cited

U.S. PATENT DOCUMENTS

| | | | | |
|---|---|---|---|---|
| 3,780,306 | A * | 12/1973 | Anderson et al. | 250/428 |
| 4,339,411 | A * | 7/1982 | Knackstedt et al. | 376/272 |
| 4,663,533 | A * | 5/1987 | Kok et al. | 250/506.1 |
| 4,806,771 | A * | 2/1989 | Mallory | 250/506.1 |
| 2005/0224729 | A1* | 10/2005 | Tamaki | 250/507.1 |
| 2006/0251201 | A1* | 11/2006 | Singh | 376/272 |
| 2008/0031396 | A1* | 2/2008 | Singh et al. | 376/272 |
| 2008/0265182 | A1 | 10/2008 | Singh et al. | |
| 2009/0114856 | A1 | 5/2009 | Shimojo et al. | |

* cited by examiner

*Primary Examiner* — Sean P Burke

(74) *Attorney, Agent, or Firm* — The Belles Group, P.C.

(57) ABSTRACT

A thermally conductive cask for storing high level radioactive waste. In one aspect the invention can be a thermally conductive cask comprising: a gamma shielding cylindrical body forming a cavity for receiving high level radioactive waste and having an outer surface formed of a first material having a first thermal conductivity; a neutron shielding cylindrical body surrounding the gamma shielding cylindrical body and having a layer formed of a second material having a second thermal conductivity that is greater than the first thermal conductivity, the layer forming an inner surface of the neutron shielding cylindrical body; and wherein the layer is clad to the outer surface of the gamma shielding cylindrical body.

25 Claims, 9 Drawing Sheets

B&W 15x15 Fuel Assembly Decay Heat Curves

CASK APPARATUS, SYSTEM AND METHOD FOR TRANSPORTING AND/OR STORING HIGH LEVEL WASTE

CROSS-REFERENCE TO RELATED PATENT APPLICATIONS

The present application claims the benefit of U.S. Provisional Patent Application No. 61,173/392, filed Apr. 28, 2009, the entirety of which is hereby incorporated by reference.

FIELD OF THE INVENTION

The present invention relates generally to apparatus, systems and methods for transferring, supporting and/or storing high level waste ("HLW"), and specifically to containers and components thereof for transferring, supporting and/or storing high level radioactive materials, such as spent nuclear fuel.

BACKGROUND OF THE INVENTION

In the operation of nuclear reactors, it is customary to remove fuel assemblies after their energy has been depleted to a predetermined level. Upon removal, this spent nuclear fuel ("SNF") is still highly radioactive and produces considerable decay heat, requiring that great care be taken in its packaging, transporting, and storing. Specifically, SNF emits extremely dangerous neutrons (i.e., neutron radiation) and gamma photons (i.e., gamma radiation) in addition to generating an amount of heat, if not properly removed, sufficient to cause damage to at least some the materials of the containers in which it is stored and potentially compromising the integrity of the cask.

It is imperative that these neutrons and gamma photons be contained at all times during transportation and storage of the SNF. It also imperative that the residual decay heat emanating from the SNF have a path to escape to avoid the cask reaching unsafe temperatures. Thus, containers used to transport and/or store SNF must not only safely enclose and shield the radioactivity of the SNF, they must also provide an effective way to remove the heat produced by the SNF. Such transfer and/or storage containers are commonly referred to in the art as casks.

Generally speaking, there are two types of casks used for the transportation and/or storage of SNF, ventilated vertical overpacks ("VVOs") and thermally conductive casks. VVOs typically utilize a sealable canister that is loaded with SNF and positioned within a cavity of the VVO. Such canisters often contain a basket assembly for receiving the SNF. An example of a canister and basket assembly designed for use with a VVO is disclosed in U.S. Pat. No. 5,898,747 (Singh), issued Apr. 27, 1999, the entirety of which is hereby incorporated by reference. The body of a VVO is designed and constructed to provide the necessary gamma and neutron radiation shielding for the SNF loaded canister. In order to cool the SNF within the canister, VVOs are provided with ventilation passageways that allow the cooler ambient air to flow into the cavity of the VVO body, over the outer surface of the canister and out of the cavity as warmed air. As a result, the heat emanated by the SNF within the canister is removed by natural convection forces. One example of a VVO is disclosed in U.S. Pat. No. 6,718,000 (Singh et al.), issued Apr. 6, 2004, the entirety of which is hereby incorporated by reference.

The second type of casks are thermally conductive casks. In comparison to VVOs, thermally conductive casks are non-ventilated. In a typical thermally conductive cask, the SNF is loaded directly into a cavity formed by the cask body. A basket assembly is typically provided within the cavity itself to guide the square fuel assemblies into the proper location and to secure the SNF in place. As with the VVOs, the body of the thermally conductive cask is designed to provide the necessary gamma and neutron radiation shielding for the SNF. In contrast to VVOs, however, which utilize natural convective forces to remove the heat that emanates from the internally stored SNF, thermally conductive casks utilize thermal conduction to cool the SNF. More specifically, the cask body itself is designed to lead the heat away from the SNF via thermal conduction. In a typical thermally conductive cask, the cask body is made of steel or another metal having high thermal conductivity. As a result, the heat emanating from the SNF is conducted outwardly from the cavity and through the cask body until it reaches the outer surface of the cask body. This heat is then removed from the outer surface of the cask body by the convective forces of the ambient air.

In some instances, the use of VVOs is either not preferred and/or unnecessary. This may be due to the heat load of the subject SNF, the existing set-up/design of the storage facility at which the SNF is to be stored and/or the nuclear regulations of the country in which the storage facility is located. However, existing designs of thermally conductive casks suffer from a number of drawbacks, including without limitation: (1) less than optimal heat removal; and (2) vulnerability to the escape of radiation (i.e., shine). Additionally, existing methods of manufacture and designs of thermally conductive casks allow little to no flexibility in altering cask dimensions without a total redesign of the cask and/or retooling of the manufacturing facility.

Metal casks used to store and/or transport spent nuclear fuel must have the ability to dissipate a large quantity of heat, particularly when the fuel has a relatively high burn-up or a relatively low cooling time. Most of the heat from the cask is rejected to the environment by the lateral cylindrical surface of the cask. These and other deficiencies are remedied by the present invention.

SUMMARY OF THE INVENTION

It is an object of the present invention to provide an apparatus for transporting, storing and/or supporting high level radioactive waste having a high heat load.

It is another object of the present invention to provide an apparatus for transporting, storing and/or supporting spent nuclear fuel producing a high amount of decay heat.

A further object of the present invention is to provide an apparatus for storing spent nuclear fuel that essentially precludes the potential of radiological release to the environment.

A yet further object of the present invention is to provide an apparatus for storing, transporting and/or supporting spent nuclear fuel in a dry state.

Another object of the present invention is to create a system of storing spent nuclear fuel with two independent containment boundaries around the entirety of the spent nuclear fuel stored therein that contain radiological matter, such as gases and/or particulates.

A further object of the present invention is to provide an apparatus for storing spent nuclear fuel with two radiological shields that facilitate heat removal via a bi-metallic bonded contact therebetween.

A yet further object of the present invention is to design an exterior surface of a dry storage cask having an enhanced topography for improved heat dissipation.

In one preferred embodiment, the invention can be a thermally conductive cask comprising: a cylindrical body comprising an inner shell forming a cavity for receiving high level radioactive waste and having a longitudinal axis; an intermediate shell comprising an inner layer and an outer layer clad to the inner layer, the inner layer constructed of a material having a first thermal conductivity and the outer layer constructed of a material having a second thermal conductivity that is greater than the first thermal conductivity, the intermediate shell circumferentially surrounding the inner shell in a concentric manner so as to form a first annular gap between the intermediate shell and the inner shell of the intermediate shell; a first set of radial fins located within the first annular gap and connected to the inner shell and the intermediate shell; a gamma shielding material filling the first annular gap; an outer shell circumferentially surrounding the intermediate shell in a concentric manner so as to form a second annular gap between the outer layer of the intermediate shell and the outer shell, the outer shell constructed of the second material; a second set of radial fins located within the second annular gap and connected to the outer layer of the intermediate shell and the outer shell, the outer shell constructed of the second material; and a neutron shielding material disposed within the second annular gap; a lid connected to a top end of the cylindrical body and enclosing a top end of the cavity; and a base connected to a bottom end of the cylindrical body and enclosing a bottom end of the cavity.

In another embodiment, the invention can be a thermally conductive cask comprising: a gamma shielding cylindrical body forming a cavity for receiving high level radioactive waste and having an outer surface formed of a first material having a first thermal conductivity; a neutron shielding cylindrical body surrounding the gamma shielding cylindrical body and having a layer formed of a second material having a second thermal conductivity that is greater than the first thermal conductivity, the layer forming an inner surface of the neutron shielding cylindrical body; and wherein the layer is clad to the outer surface of the gamma shielding cylindrical body.

In still another embodiment, the invention can be a thermally conductive cask comprising: a steel inner shell forming a cavity for receiving high level radioactive waste and having a longitudinal axis; an intermediate shell comprising an inner steel layer and an outer aluminum layer clad to the inner steel layer, the intermediate shell circumferentially surrounding the inner shell in a concentric manner so as to form a first annular gap between the intermediate shell and the inner steel shell; a set of steel fins located within the first annular gap and connected to the inner shell and the intermediate shell; a gamma shielding material filling the first annular gap; an aluminum outer shell circumferentially surrounding the intermediate shell in a concentric manner so as to form a second annular gap between the aluminum layer and the outer shell; a set of aluminum radial fins located within the second annular gap and connected to the outer layer of the intermediate shell and the outer shell; and a neutron shielding material disposed within the second annular gap.

In a further embodiment, the invention can be a thermally conductive cask comprising: a gamma shielding cylindrical body forming a cavity for receiving high level radioactive waste and having an outer surface formed of a first material having a first thermal conductivity; a neutron shielding cylindrical body surrounding the gamma shielding cylindrical body, the neutron shielding cylindrical body comprising: a first shell forming an inner surface of the neutron shielding cylindrical body; a second shell concentrically surrounding the first shell so that an annular gap exists between the first and second shells; a set of connectors disposed within the annular gap and connected to the first and second shells; a neutron absorbing material filling the annular gap; and wherein the first shell, the second shell, and the connectors are constructed of a second material having a second thermal conductivity that is greater than the first thermal conductivity; and wherein the first shell is clad to the outer surface of the gamma shielding cylindrical body.

DETAILED DESCRIPTION OF THE DRAWINGS

Figure 1:
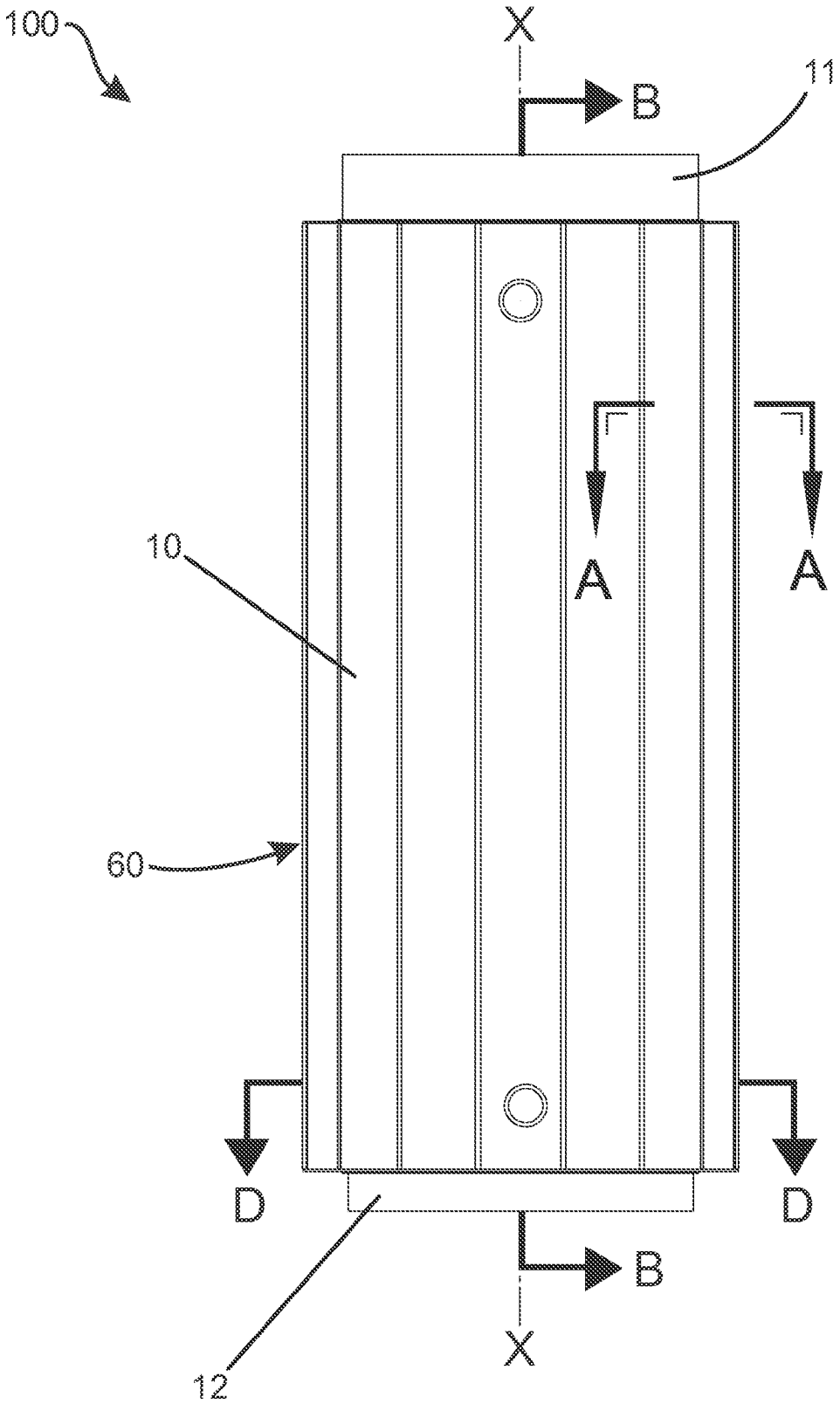
FIG. 1 is a side view of the thermally conductive transfer cask according to the present invention.
Figure 2:
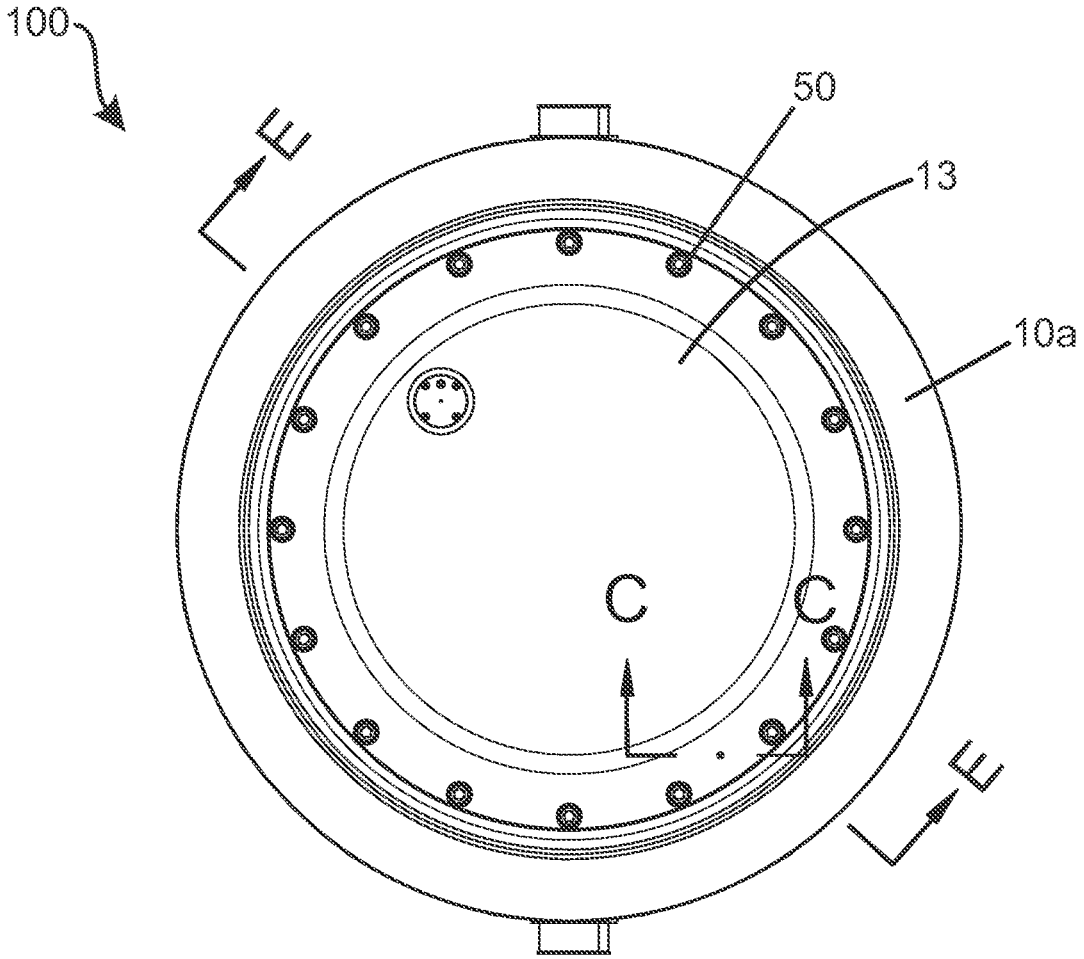
FIG. 2 is a top view of the thermally conductive transfer cask of FIG. 1.
Figure 4:
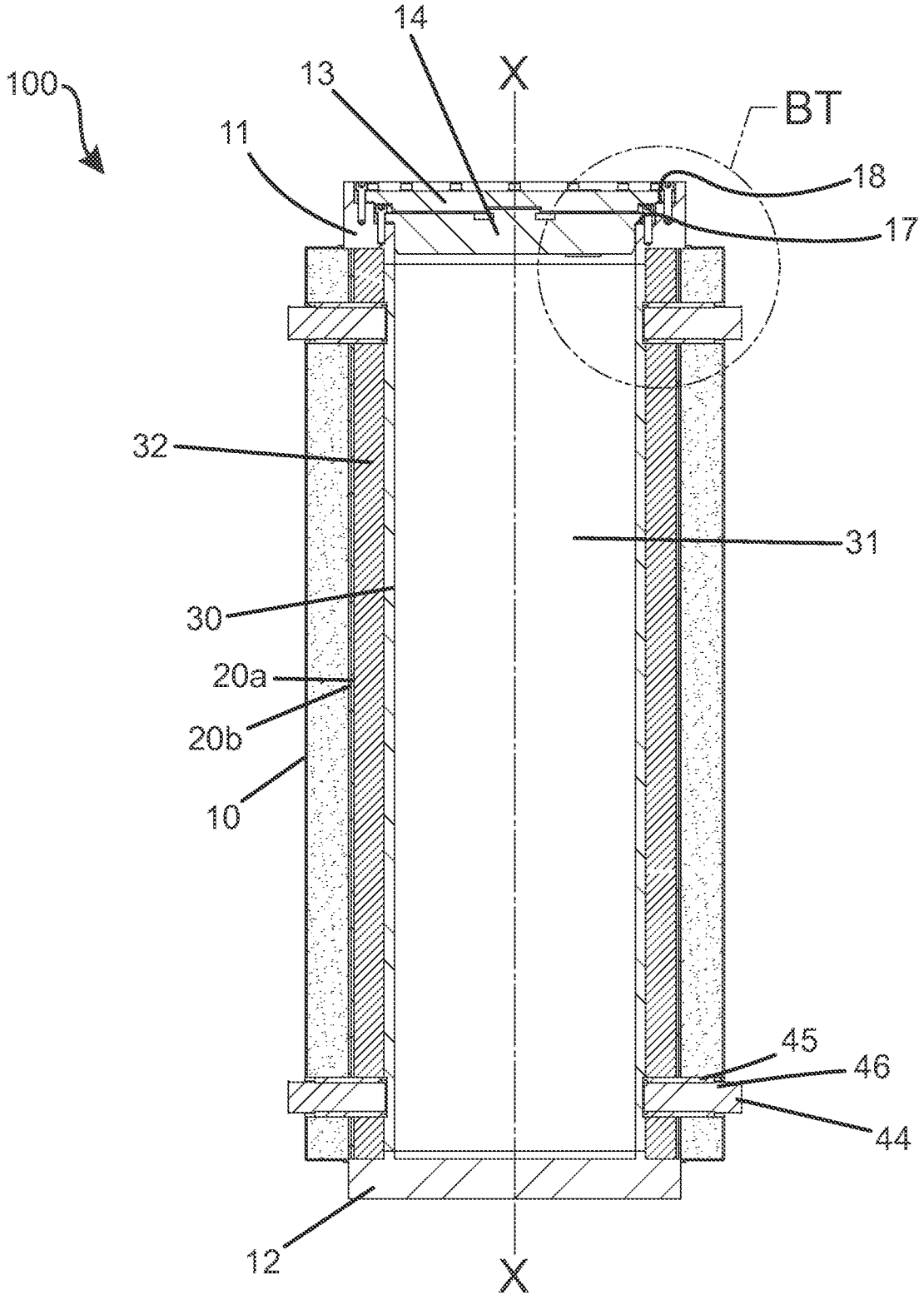
FIG. 4 is a longitudinal cross-sectional view of the thermally conductive transfer cask along line B-B of FIG. 1.

Referring to FIGS. 1, 2 and 4 concurrently, a thermally conductive cask 100 is illustrated according to one embodiment of the present invention. The thermally conductive cask 100 is designed for use in a substantially vertical orientation, as depicted in FIG. 1. However, thermally conductive cask 100 may also be utilized in a horizontal or other orientation if desired. The thermally conductive cask 100 is a substantially cylindrical containment unit extending along a central longitudinal axis X-X and having a transverse cross-sectional profile that is substantially circular in shape. It should be noted, however, that the invention is not limited to cylinders having a circular transverse cross-sectional shape but includes cylindrical containers having cross-sectional profiles that are, for example, rectangular, ovoid or other prismatic or polygon form. While the thermally conductive cask 100 is particularly useful for storing and/or transporting spent nuclear fuel ("SNF") assemblies, the invention is in no way limited by the type of radioactive waste or materials to be stored therein. The thermally conductive cask 100 can be used to transport and/or store any type of radioactive HLW. With that said, the thermally conductive cask 100 is particularly suited for the transport, storage and/or cooling of radioactive materials that have a high residual heat load and that produce neutron and gamma radiation, such as SNF.

The thermally conductive cask 100 comprises a heat conducting body 60, which in the exemplified embodiment, comprises three concentrically arranged tubular shells, namely an inner shell 30, an intermediate shell 20 and an outer shell 10. As discussed in greater detail below, the heat conducting body 60 comprises a gamma radiation shielding cylindrical body and a neutron radiation shielding cylindrical body that concentrically surrounds the gamma radiation shielding cylindrical body. Thus, the heat conducting body 60 provides the necessary gamma and neutron radiation shielding properties while at the same time facilitating improved cooling of the HLW stored inside the cavity by efficiently conducting heat away from the HLW.

The heat conducting body 60 forms an internal storage cavity 31 for receiving and storing the SNF assemblies, which still give off considerable amounts of heat. The thermally conductive cask 100 forms a containment boundary about the storage cavity 31 (and thus the stored SNF assemblies). The containment boundary can be literalized in many ways, including without limitation a gas-tight containment boundary, a pressure vessel, a hermetic containment boundary, a radiological containment boundary, and a containment boundary for fluidic and particulate matter. These terms are used synonymously throughout this application. In one instance, these terms generally refer to a type of boundary that surrounds a space and prohibits all fluidic and particulate matter from escaping from and/or entering into the space when subjected to the required operating conditions, such as pressures, temperatures, etc.

The internal storage cavity 31 is sealed at its bottom end by a base 12 and is sealed at its top end by a series of removable lids 13, 14 (FIG. 4). The base 12 is connected to a bottom end of the heat conducting body 60 while the lids 13, 14 are bolted to a top structural ring 11. Both the base 12 and the structural ring 11 are thick steel forgings.

The outer shell 10 is preferably formed of aluminum (or an aluminum alloy) and the base 12 and top structural ring 11 are preferably formed of an alloy steel, such as, for example, SA 350 LF3. A top view of the thermally conductive cask 100 is shown in FIG. 2 with the secondary lid 13 installed with bolts 50. From this perspective, an upper portion 10*a* of the outer shell 10 is shown.

Figure 3:
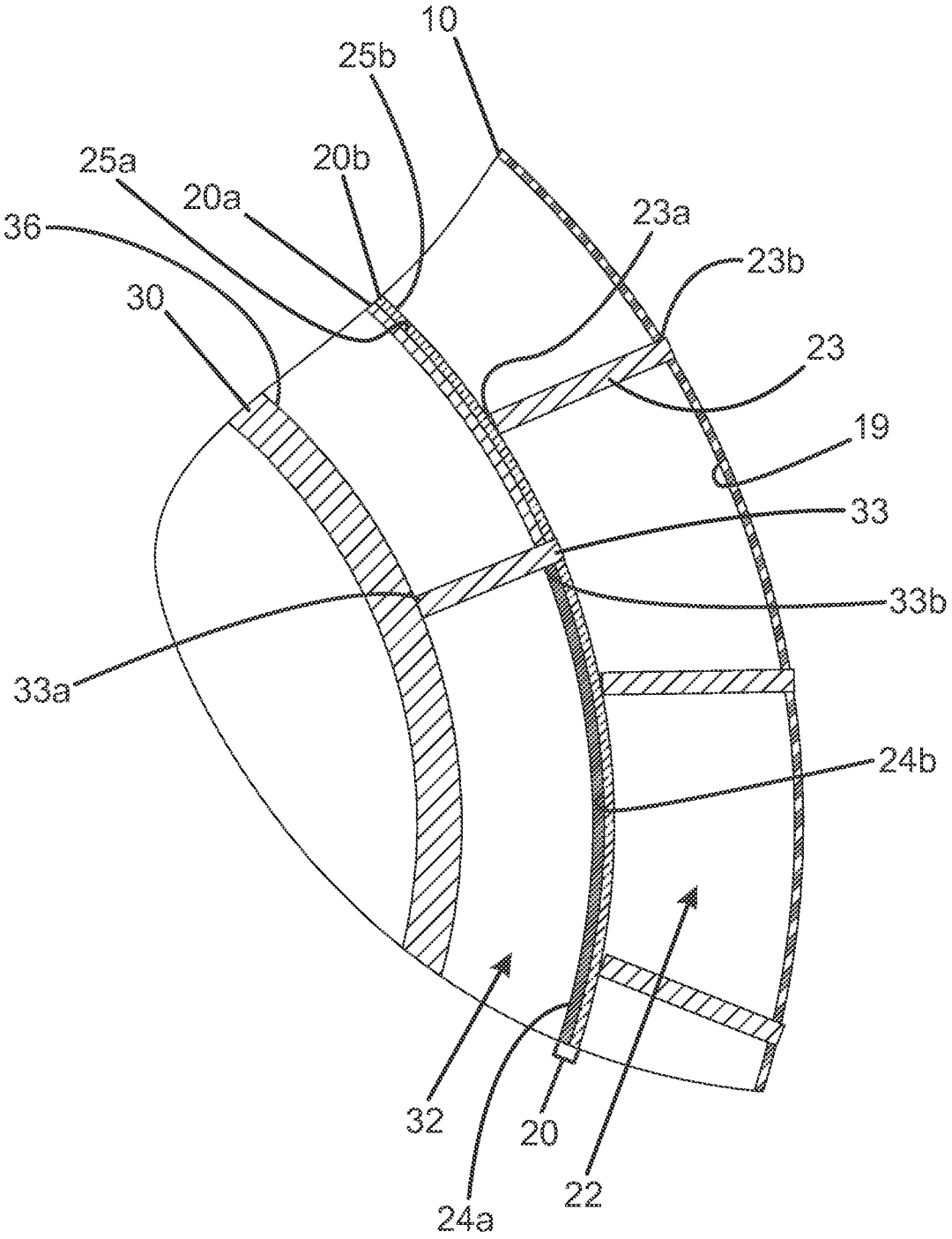
FIG. 3 is a lateral cross-sectional view of the thermally conductive transfer cask along line A-A of FIG. 1.

Referring now to FIGS. 3 and 4 concurrently, the internal components making up the heat conducting body 60 of the thermally conductive cask 100 according to one embodiment of the present invention will be discussed. As noted above, the heat conducting body 60 comprises the inner shell 30, the intermediate shell 20 and the outer shell 10. The intermediate shell 20 is a multi-layer shell and comprises an inner layer 20*a* and an outer layer 20*b*. Of course, the intermediate shell 20 is so not limited and may, in certain embodiments, comprise more than two layers.

The inner shell 30 is the innermost shell of the body 60. As a result, the inner surface of the inner shell forms the cavity 31 in which the SNF assemblies are placed and held for storage and/or transport. The inner shell 30 forms the initial boundary separating the SNF from the external environment. Accordingly, the inner shell 30 is preferably made of a high strength steel such as, for example, SA 203 E and is preferably sufficiently thick to account for the known degradations in molecular structure from long-term exposure to neutron and gamma rays. Steel is also a preferred material to use for the inner shell 30 due to its good thermal conductivity, which is important for providing a path for the decay heat generated by the contained radioactive material to pass through (and ultimately be dissipated into the environment). Finally, steel is also preferred due to its high melting point, which ensures that the integrity of the inner shell 30 is not compromised even at high temperatures.

Any of the shells may be formed by bending a rectangular plate into a cylinder or other shape and welding together the two meeting ends, welding a series of elongated rectangular plates together end-to-end, or by any other method known to those skilled in the art to produce the desired shape. A machining process may also be used.

The intermediate shell 20 is concentrically arranged to circumferentially surround an outer surface 36 of the inner shell 30. The intermediate shell 20 is both concentric and coaxial with the inner shell 30. The intermediate shell 20 is spaced apart from the inner shell 30, thereby forming a first annular gap 32 between the intermediate shell 20 and the inner shell 30. Similarly, the outer shell 10 circumferentially surround an outer surface 36 of the intermediate shell 20. The outer shell 10 is both concentric and coaxial with the inner shell 30 and the intermediate shell 20. The outer shell 20 is spaced apart from the intermediate shell 20, thereby forming a second annular gap 32 between the intermediate shell 20 and the outer shell 10. The term "concentric" as used herein is not limited to an arrangement wherein the shells 10, 20, 30 are coaxial, but includes arrangements wherein the shells 10, 20, 30 may be offset. Furthermore, the term "annular," as used herein, is not limited to a circular shape and does not require that the object or space have a constant width. For example, the inner shell 10 may have a circular transverse cross-section while the intermediate shell 20 may have a rectangular transverse cross-section.

As mentioned above, the intermediate shell 20 is preferably made of two or more metallic layers. As used herein, the terms metal and metallic refer to both pure metals and metal alloys. In a preferable embodiment, the inner layer 20*a* is formed of a material having a first coefficient of thermal conductivity and the outer layer 20*b* is formed of a material having a second coefficient of thermal conductivity that is greater than the first coefficient of thermal conductivity. In the preferred embodiment, the inner layer 20*a* is preferably formed of a carbon steel material so that it can be welded or otherwise connected to a first set of radial fin 33 as will be described below. The outer layer 20*b* is preferably formed of an aluminum material, more preferably a soil aluminum, due to its advantageous heat conducting and heat dispersion properties. As used herein, the term aluminum includes both pure aluminum and aluminum alloys, including all grades thereof. Furthermore, when it is referred that two components are made of the same material, and specifically the same metal, each of the components may be made of the metal in its pure form or an alloy of that metal, including all grades thereof. In other words, if a layer and a fin are both said to be made of aluminum, the layer may be made of pure aluminum while the fin is made of an aluminum alloy or the layer and fin may be made of different grades of aluminum alloy.

As can be seen, the intermediate shell 20 is formed of two layers 20*a*, 20*b* that are formed of different materials. As is known in the art, aluminum can not be welded to steel. In other words, aluminum and steel are examples of metals that are metallurgically incompatible from a welding standpoint. Thus, in the preferred embodiment of the invention, the inner and outer layers 20*a*, 20*b* of the intermediate shell 20 can not be connected together by a welding process. Thus, it is preferred that the outer layer 20*b* be clad to the inner layer 20*a*. As a result of this cladding, the outer surface 25*a* of the inner layer 20*a* is in continuous conformal surface contact with the inner surface 24*b* of the outer layer 20*b*. This conformal surface contact is important so that an efficient heat transfer occurs between the layers 20*a*, 20*b* in order to conduct heat away from the cavity 31 and to the external environment.

The inner and outer layers 20*a*, 20*b* are fixedly bonded together through the cladding process. The inner layer 20*a* has an inner surface 24*a* and an outer surface 25*a* while the outer layer 20*b* has an inner surface 24*b* and an outer surface 25*b*. The inner surface 24*a* of the inner layer 20*a* is adjacent the annular gap 32 between the intermediate shell 20 and the inner shell 30. The outer surface 25*b* of the outer layer 20*b* is adjacent the annular gap 22 between the intermediate shell 20 and the outer shell 10. Structurally, through the cladding, the inner and outer layers 20*a*, 20*b* form a single shell structure, such as the intermediate shell 20. Thus, benefits may be realized from having the structural characteristics of the steel at the same time as having the thermal conductivity characteristics of the aluminum within one, single shell. Moreover, the existence of the aluminum layer 20*b* allows the radial fins 23 that are responsible for conducting heat through the neutron shielding material (which is poor heat conductor) to be constructed out of aluminum.

In one preferred embodiment, the inner layer 20*a* is clad to the outer layer 20*b* by a metallurgical bonding process such as explosion bonding. Such a process would comprise explosion bonding a soft aluminum such as, for example grade 1100 soft aluminum, onto ductile carbon steel, such as for example SA516 Gr. 55. Forming a bi-metallic intermediate shell 20 enables a first set of radial fins 33 made of a first material (such as steel) to be welded to the inner layer 20*a* of the intermediate shell 20 and a second set of radial fins 23 made of a second material (such as aluminum) to be welded to the outer layer 20*b* of the intermediate shell 20 as will be described below. Furthermore, the inner and outer layers 20*a*, 20*b* are in substantially continuous surface contact with one another so that no air gaps exist between the two layers 20*a*, 20*b*, thereby promoting the outward transfer of heat as will be described below. Of course, in addition to explosion bonding, other methods exist for cladding the two metallurgically incompatible metals of the first and second layers 20*a*, 20*b*. For example, one alternative cladding method is roller bonding.

The annular gap 32 between the inner shell 30 and the intermediate shell 20 is preferably filled with a radiation-absorbing material, such as lead, which is generally known to have a high absorption rate of various forms of radiation including gamma rays. Having a good thermally conductive material, such as lead, fill the annular gap 32 also serve as a good path for heat generated by the HLW located within the cavity 31 of the inner shell 30 to dissipate outward to the inner layer 20*a* of the intermediate shell 20. Lead is the preferred gamma shielding filler material because it is better gamma radiation shielding material per pound than almost all other materials and is also a good heat conductor. Of course, it is possible for the entire inner gamma shielding cylindrical body (which consists of the inner shell 10, the lead, the radial fins 33, and the inner layer 20*a*) to be constructed entirely as a unitary thick steel shell if desired. In other words, the invention is not limited to an embodiment that uses an inner shell separated from an intermediate shell and filled thereby by a gamma radiation shielding material.

In one alternative embodiment, the inner shell 30 may be a very thick steel shell that has an inner surface forming the cavity 31 and an outer surface that acts as the outer surface 25*a* to which the aluminum layer is clad. Such a design provides additional structural rigidity to the cask 100 while still providing gamma radiation shielding and heat conductivity.

Furthermore, the thermally conductive cask 100 may be comprised of two cylindrical bodies including a gamma shielding cylindrical body and a neutron shielding cylindrical body. In such an embodiment, the gamma shielding cylindrical body forms the cavity 31 for receiving high level radioactive waste. The gamma shielding cylindrical body also has an outer surface formed of a first material having a first thermal conductivity. The neutron shielding cylindrical body surrounds the gamma shielding cylindrical body and has an inner surface formed of a second material that has a thermal conductivity that is greater than the first thermal conductivity. As discussed above, because the inner surface of the neutron shielding cylindrical material is formed of a different material than the outer surface of the gamma shielding cylindrical body, these two surfaces cannot be connected via welding. Therefore, the inner surface of the neutron shielding cylindrical body is preferably clad to the outer surface of the gamma shielding cylindrical body so that they are fixedly bonded and in conformal surface contact.

Conceptually, the heat conducting body 60 can be separated into a gamma shielding cylindrical body and a neutron shielding cylindrical body that concentrically surrounds the gamma shielding cylindrical body. In such an embodiment, the gamma shielding cylindrical body may be a solid structure (such as steel) or be a multi-shell assembly as discussed above. Furthermore, the neutron shielding cylindrical body will still have two layers of material (or shells) separated by an annular gap with radial fins connecting the two layers (shells) and which is filled by the appropriate neutron shielding material.

Referring now solely to FIG. 3, extending out radially from an outer surface 36 of the inner shell 30 to the inner layer 20*a* of the intermediate shell 20 is a first set of radial fins 33. As used herein, the terms "radially" and "radial" are not intended to be limited to structures that extend from or converge with the central longitudinal axis A-A. Rather, the terms "radially" and "radial" include structures that extend in a direction away from a center point without actually contacting the center point. The radial fins 33 are preferably longitudinal ribs that extend the entire height of the inner shell 30 within the annular gap 32. The radial fins 33 separate the annular gap 32 into circumferential sections. However, the invention is not so limited and the radial fins 33 may be ribs that only extend partially along the height of the inner shell 30 or can be post-like members that extend radially outward from the inner shell 30 to the intermediate shell 20 without serving as boundaries. Preferably, the connections between the ends of the radial fins 33 and the inner shell 30 to the intermediate shell 20 are accomplished via welding.

The radial fins 33 are preferably made of carbon steel similarly to the inner layer 20*a* of the intermediate shell 20. However, if the inner layer 20*a* of the intermediate shell 20 is made of some material other than carbon steel, the material of the radial fins 33 may be changed to match the material of the inner layer 20*a*. The radial fins 33 serve primarily to secure the inner and outer layers 20*a*, 20*b* of the intermediate shell 20 to the inner shell 30 and to conduct heat from the inner shell 30 outward. Although the radial fins 33 are shown as penetrating through both the inner and outer layers 20*a*, 20*b* of the intermediate shell 20 in FIG. 3, in another preferred embodiment, the radial fins 33 extend only to the inner surface 24*a* of the inner layer 20*a* or partially through the inner layer 20*a*. The radial fins 33 are then welded or otherwise connected to the inner and intermediate shells 30, 20 as described below.

As noted above, the radial fins 33 are made of carbon steel similarly to the inner shell 30 and the inner layer 20*a* of the intermediate shell 20. As such, the radial fins 33 are able to be welded at a first end 33*a* to the inner shell 30 and at a second end 33*b* to the inner layer 20*a* of the intermediate shell 20. As used herein, the term welding includes, but is not limited to, solid state welding, friction welding, diffusion welding, explosive welding, fusion welding, low energy input welding or arc welding. Furthermore, the radial fins 33 may be connected to the inner shell 30 and the inner layer 20*a* of the intermediate shell 20 by alternative means such as, for example, mechanical means including rivets, adhesives or threaded screws and bolts. Of course, as discussed above, the radial fins 33 may be omitted altogether if the inner shell 30 is a thick steel shell extending from the inner surface that forms the cavity 31 to the outer surface 25*a*.

Referring still to FIGS. 3 and 4, as noted above, the outer shell 10 is concentrically spaced apart from the outer layer 20*b* of the intermediate shell 20 thereby creating the second annular gap 22 in between an inner surface 19 of the outer shell 10 and the outer surface 25*b* of the outer layer 20*b* of the intermediate shell 20. The annular gap 22, also referred to as a neutron radiation shielding section, is preferably filled with a hydrogen-rich material such as, for example, Holtite, water or any material that is rich in hydrogen and a Boron-10 isotope. Filling the annular gap 22 with a neutron shielding material prevents neutron radiation from passing through the cask 100 and into the external environment.

A second set of radial fins 23 extend out radially from the outer layer 20*b* of the intermediate shell 20 to the outer shell 10. The radial fins 23 are heat conduction elements, in the form of plates, that are positioned across the annular gap 22 such that a first end 23*a* of the radial fins 23 is connected to the outer surface 25*b* of the outer layer 20*b* of the intermediate shell 20 and a second end 23*b* of the radial fins 23 is connected to the outer shell 10. Again, although the second set of radial fins 23 are shown as penetrating or protruding through the outer shell 10, they may extend only to the inner surface 19 of the outer shell so as to be welded thereto. In a further preferred embodiment, some or all of the radial fins 23 may penetrate a portion or the entirety of the outer shell 10 and extend beyond the outer surface of outer shell 10, thereby increasing the surface area exposed to the outer environment and increasing the heat dispersion ability of the thermally conductive cask 100.

The second set of radial fins 23 are preferably made of aluminum. As such, the second set of radial fins 23 are comprised of the same material as the outer layer 20*b* of the intermediate shell 20 and the outer shell 10. Having the radial fins 23 made of aluminum enables the radial fins 23 to be welded to the outer layer 20*b* of the intermediate shell 20 and to the outer shell 10.

The primary purpose of the second set of radial fins 23 is to transfer heat from the outer layer 20*b* of the intermediate shell 20 to the outer shell 10, where it may be released into the environment. Importantly, the neutron shield material is a rather thermally non-conductive material, thereby preventing heat from the spent nuclear fuel rods from reaching the environment. Therefore, the second set of radial fins 23 are preferably numerous and are made of aluminum or another material having a particularly high thermal conductivity. They are preferably thick and, in one embodiment, are at least one inch in thickness to improve the thermal conductivity. By making the second set of radial fins 23 out of aluminum, the heat is able to be moved outwardly from the cavity 31 and then dispersed into the environment upon reaching the outer shell 10.

The second set of radial fins 23 are positioned at an oblique angle with respect to the outer layer 20*b* of the intermediate shell 20 and the outer shell 10. In other words, each of the radial fins 23 is positioned so as not to form a right angle with either of the outer layer 20*b* of the intermediate shell 20 or the outer shell 10. This serves to further minimize the amount of radiation that will be capable of streaming through these fins 23 and, thus, out of the cask 100.

The first set of radial fins 33 is preferably circumferentially offset from the second set of radial fins 23. In other words, a direct line will not exist from the inner shell 10, through the first set of radial fins 33 and into the intermediate shell 20 and then through the second set of radial fins 23. Rather, each of the radial fins 33 will be positioned at some location in between adjacent radial fins 23 and vice versa. Such a circumferentially offset arrangement will assist with preventing neutron radiation from streaming through the radial fins 23, 33 and reaching the environment external to the cask 100.

As noted above, the outer shell 10 is preferably made entirely from aluminum or another material having a high thermal conductivity and is preferably welded to each radial fin 23 to maximize heat transfer. The outer shell 10 also may be formed by bending a rectangular plate into a cylinder and welding together the two meeting ends, welding a series of elongated rectangular plates together end-to-end, or by any other way to produce the desired shape. It is also important to note that the outer shell 10 preferably has enhanced surface features such as dimples or cylindrical or helical undulations in the manner of a threaded spindle so as to increase surface area and may increase the turbulent air flow along the surface of the outer shell 10.

In one alternative embodiment, an additional layer of steel or other metal may substantially surround the outer shell 10 if desired. However, because at least an inner later of the outer shell 10 would be made of aluminum for connecting to the fins 23, the additional layer of steel would have to be cladded together with the aluminum layer in order to enable heat to conduct through the outer shell 10. If used, the additional layer of steel will provide added structural rigidity to the thermally conductive cask 100. Of course, connecting an additional layer of steel to an outer surface of the outer shell 10 is not necessary.

Referring solely now to FIG. 4, a lateral cross-sectional view of the thermally conductive transfer cask 100 along line B-B of FIG. 1 is illustrated according to one embodiment of the present invention. From this perspective, outer shell 10, inner and outer layers 20*a*, 20*b* of the intermediate shell 20 and containment shell 30 are seen oriented along axis X-X and extending from the base 12 to the upper structural ring 11 of the thermally conductive cask 100. It is preferred that the upper structural ring 11 and the base 12 are made of carbon steel and are each welded to the respective ends of the inner shell 30. Once the cavity 31 of the inner shell 30 is loaded from the top, the primary lid 14 may first be installed over an opening of the structural ring 11. The structural ring 11 has a multi-stepped inner surface with at least two tread surfaces 17, 18. The inner tread 17 is for receiving the primary lid 14 while the outer tread 18 is for receiving the secondary lid 13.

Figure 5:
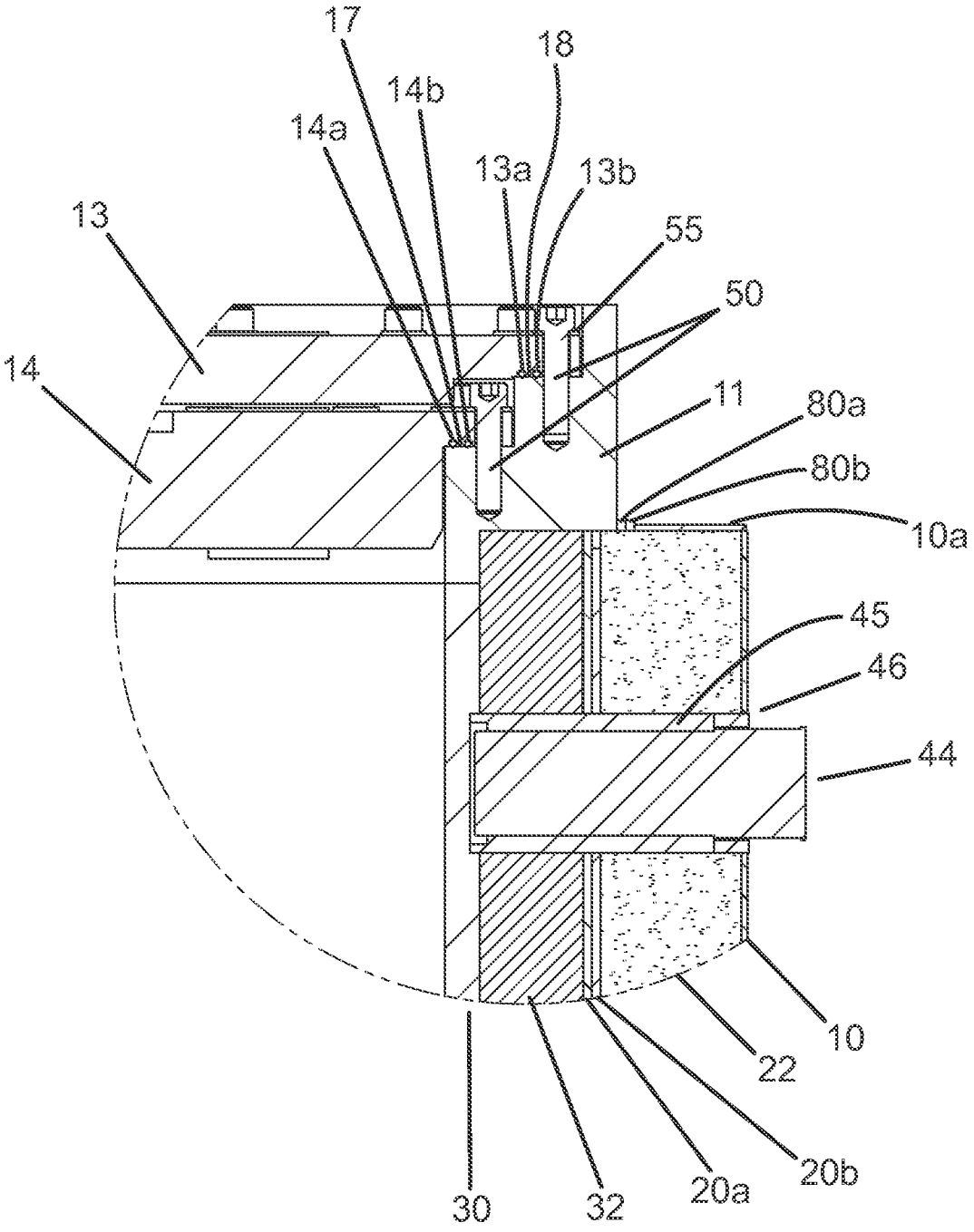
FIG. 5 is a close-up view of area BT of FIG. 4.

Referring to FIG. 5, a close-up area BT of FIG. 4 is illustrated. An inner and outer seal 14*a*, 14*b* of the primary lid 14 can be seen sealing the mating surface between the primary lid 14 and the inner tread surface 17 of the structural ring 11. An inner and outer seal 13*a*, 13*b* of the secondary lid 13 are additionally shown sealing the mating surface between the secondary lid 13 and the upper tread surface 18 of the structural ring 11. The primary and secondary lids 13, 14 are preferably secured to the thermally conductive cask by a plurality of bolts 50 extending through holes in the primary and secondary lids 14 and 13 and threadily engaging into structural ring 11, as is shown in FIGS. 4 and 5. The types of bolts used may preferably be designed or selected to be capable of being installed remotely with tools having extended arms as the loading and sealing of the cask typically takes place under borated water to limit radiation exposure to the workers. FIG. 2 shows a preferred bolt pattern for use on the secondary lid 13 which may also be used on primary lid 14.

Figure 6:
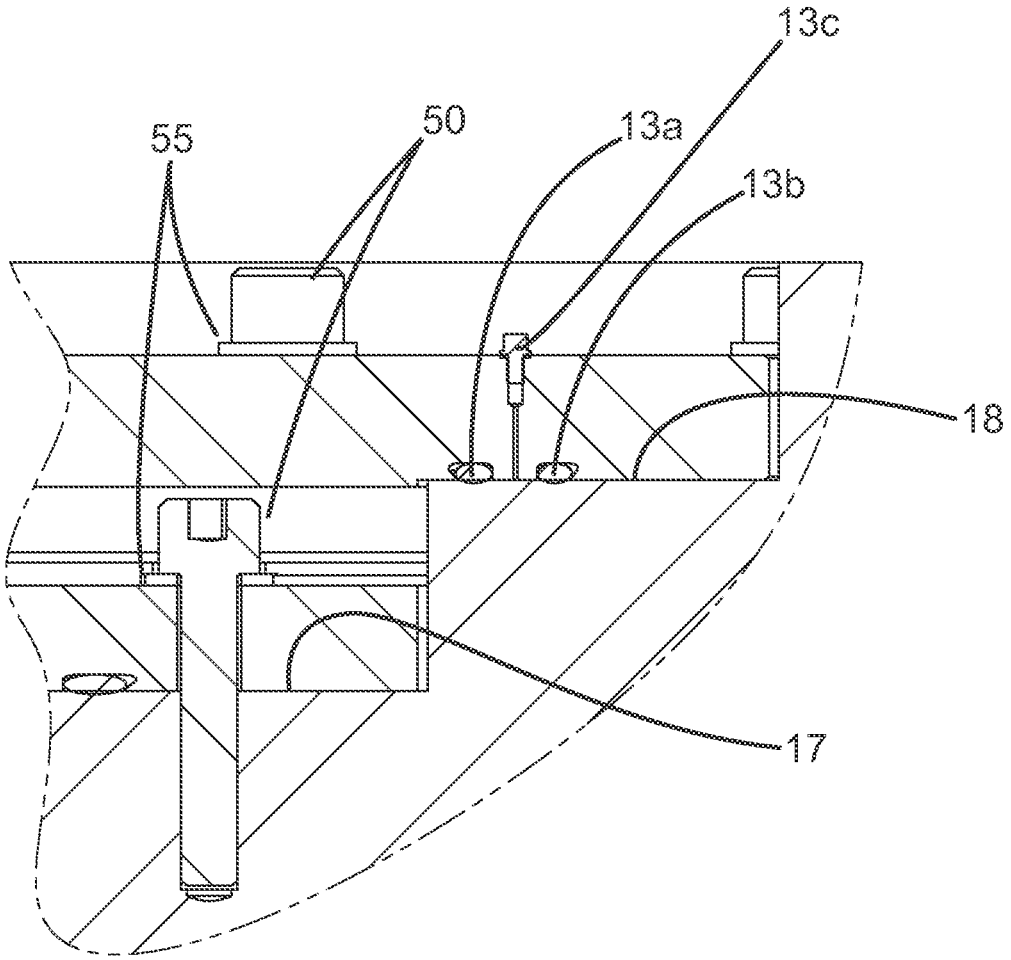
FIG. 6 is a longitudinal cross-sectional view of the thermally conductive transfer cask along line C-C of FIG. 2.

The detail illustrated in FIG. 6 shows interseal test port 13*c* providing access to the volume between the secondary lid inner seal 13*a* and outer seal 13*b*. Interseal test port 13*c* is used to test the integrity of the secondary inner seal 13*a* in addition to the primary lid inner and outer seals 14*a* and 14*b*. This may be done by determining whether the inert gas that was placed in the containment shell has escaped past the seals with, for example, a pressure gage.

Figure 7:
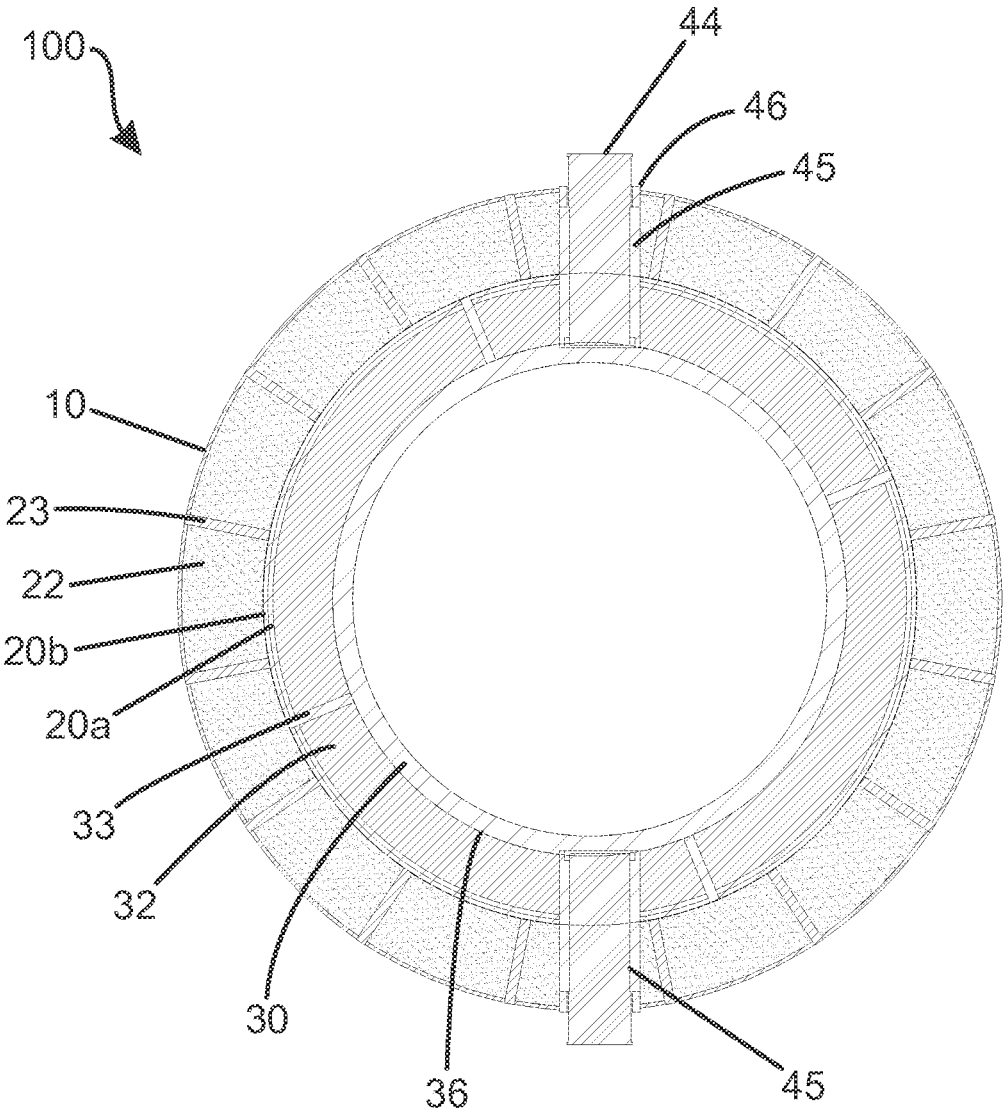
FIG. 7 is a lateral cross-sectional view of the thermally conductive transfer cask along line D-D of FIG. 1.

Turning now to FIG. 7, trunnion sleeves 45 extending from the exterior of the inner shell 30 nearly to the exterior of the outer shell 10 are illustrated. The trunion sleeves 45 are preferably made of carbon steel and are welded directly to the outer surface 36 of the inner shell 30 to provide maximum strength. FIG. 7 also illustrates how trunnion sleeves 45 are angularly offset from the first and second sets of radial fins 33, 23, thus avoiding any irregular heating or hot spots from developing on the inner shell 30.

Referring back to FIG. 4, four steel trunnion sleeves 45 are shown housing four lifting trunnions 44. The lifting trunnions 44 provide external handles for moving and securing the thermally conductive cask 100 when vertically or horizontally oriented. Additionally, aluminum trunnion sleeves 46 are shown extending beyond trunnion sleeves 45 where they are preferably bonded to both the steel trunnion sleeves 45 and the outer shell 10.

Figure 8:
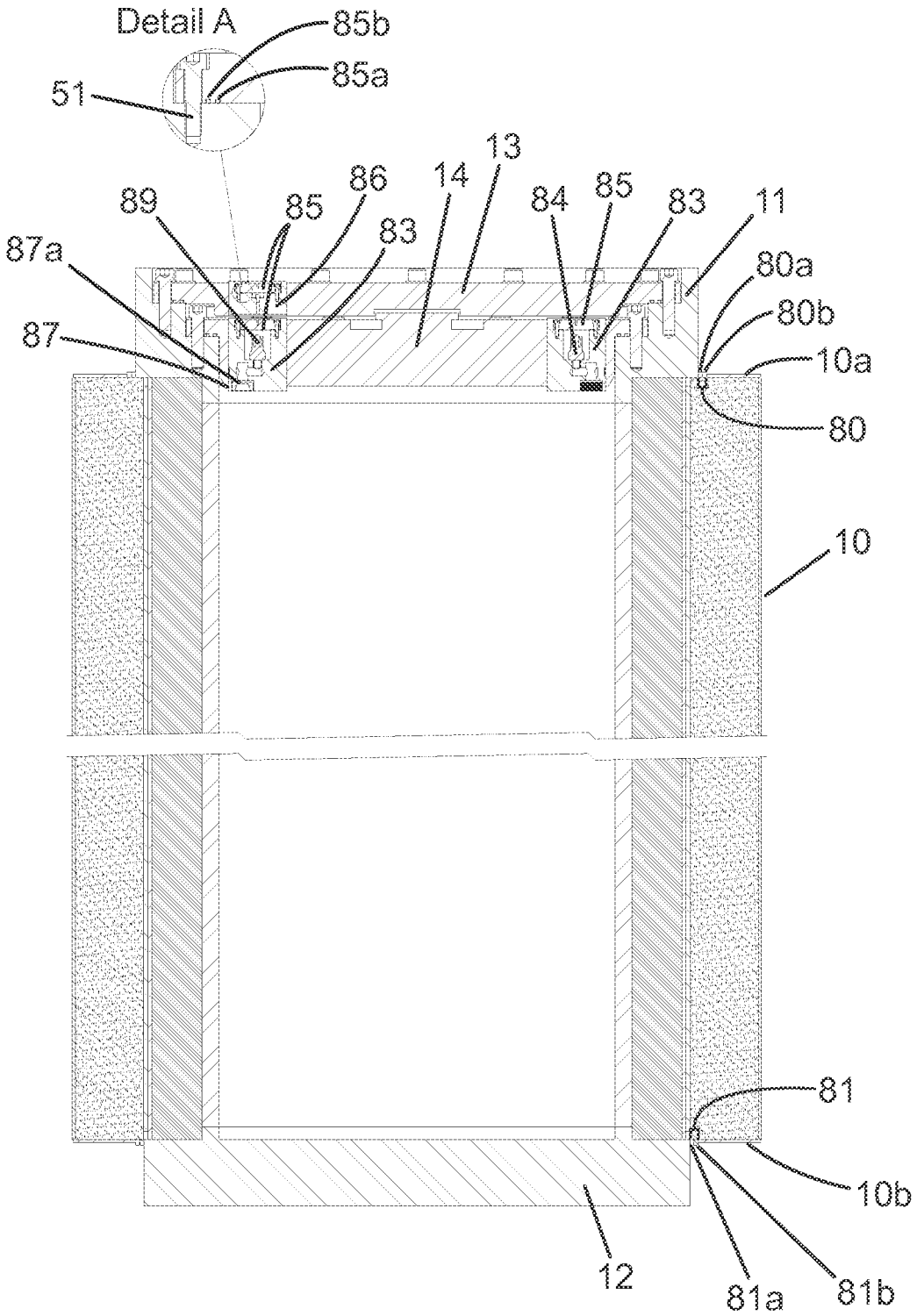
FIG. 8 is a longitudinal cross-sectional view of the thermally conductive transfer cask along line E-E of FIG. 2 having certain components identified.

Illustrated in FIG. 8 is another lateral cross-sectional view of the thermally conductive transfer cask 100 along line E-E of FIG. 2 according to a preferred embodiment. This view shows certain additional components located on the primary lid 14 and secondary lid 13. Also located in the primary lid 14 are one or more primary lid vent/drain blocks 83 housing vents. These vents preferably have a double shut-off quick disconnect coupling 84 leading to a drain line 87 with seal 87*a*. Port covers 85 are bolted to the upper flange of the primary lid vent/drain blocks 83 prior to the secondary lid 13 being installed. The secondary lid also has a vent block 86. A port cover 85 is bolted to the upper flange of the secondary lid vent block 86 with bolts 51. Detail A shows a preferred embodiment of the port covers having double o-ring seals 85*a* (inner) and 85*b* (outer).

Referring now to FIGS. 5 and 8 concurrently, an upper transition ring 80 is located where the exterior of the structural member 11 meets the upper portion 10*a* of the outer shell 10. The upper transition ring 80 is comprised of a carbon steel inner perimeter 80*a* and an aluminum cladded outer perimeter 80*b*; enabling it to be welded to both the steel structural ring 11 and the aluminum upper portion 10*a* of the outer shell 10. Similarly, a lower transition ring 81 is located where the exterior of the base 12 meets the lower portion 10*b* of the outer shell 10. The lower transition ring 81 is comprised of a carbon steel inner perimeter 81*a* and an aluminum cladded outer perimeter 81*b*; enabling it to be welded to both the steel base 12 and the aluminum lower portion 10*b* of the outer shell 10.

Figure 9:
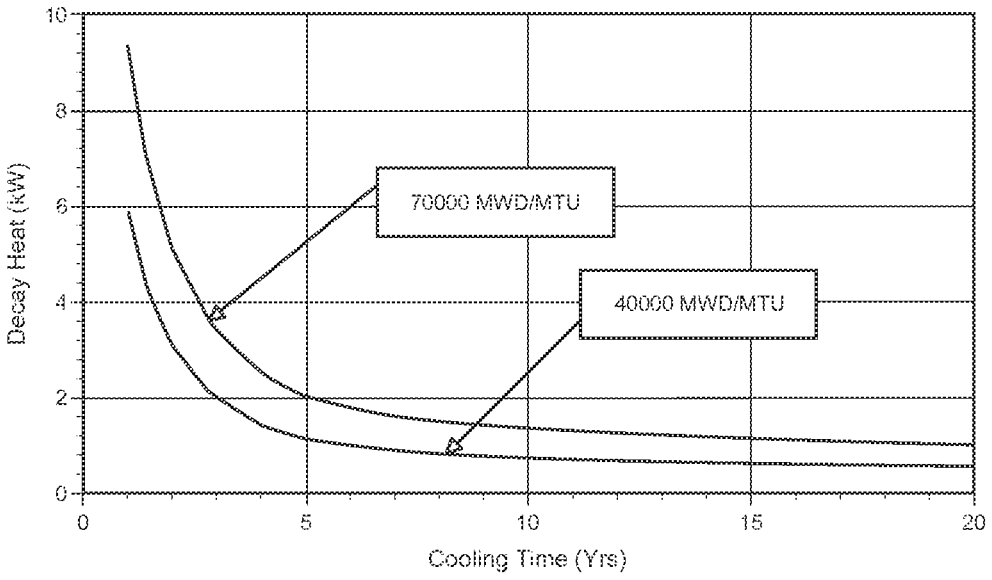
FIG. 9 is a graph showing cooling time v. decay heat for B&W15×15 Fuel Assemblies.

Referring to FIG. 9, a graph showing cooling time in years versus decay heat in kilowatts for a 70000 MWD/MTU fuel assembly and a 40000 MWD/MTU fuel assembly is illustrated. As can be seen, the fuel assembly achieves a significant cool down in the first five years, a minor cool down from years five to ten, and a fairly level amount of decay heat from year ten on.

In one preferred embodiment the invention can be a thermally conductive cask with components made from the materials disclosed in the following parts list

| Item | FIG. | Material | Part Name |
|---|---|---|---|
| 85a | 8A | Elastomeric | Seal, Port Cover Inner |
| 85b | 8A | Elastomeric | Seal, Port Cover Outer |
| 13d | 6 | Elastomeric | Seal, Interseal Test Port |
| 87a | 8 | Elastomeric | Seal, Drain Line |
| 14b | 5 | Elastomeric | Seal, Primary Lid Outer |
| 14a | 5 | Elastomeric | Seal, Primary Lid Inner |
| 13b | 5 | Elastomeric | Seal, Secondary Lid Outer |
| 13a | 5 | Elastomeric | Seal, Secondary Lid Inner |
| 20b | 3 | Aluminum | Plate, Aluminum Intermediate |
| 23 | 3 | Aluminum | Rib, Neutron Layer |
| 10 | 3 | Aluminum | Shell, Enclosure |
| 80b | 5 | Aluminum | Ring, Upper Forging Aluminum Transition |
| 10a | 5 | Aluminum | Shell, Upper Enclosure |
| 81b | 8 | Aluminum | Ring, Lower Forging Aluminum Transition |
| 10b | 8 | Aluminum | Shell, Lower Enclosure |
| 46 | 5 | Aluminum | Sleeve, Aluminum Trunnion |
| 33 | 3 | Carbon Steel | Rib, Gamma Layer |
| 20a | 3 | Carbon Steel | Plate, Steel Intermediate |
| 80a | 5 | Carbon Steel | Ring, Upper Forging Steel Transition |
| 81a | 8 | Carbon Steel | Ring, Lower Forging Steel Transition |
| 45 | 4 | Carbon Steel | Sleeve, Steel Trunnion |
| 51 | 8 | SA 193 B7 | SHCS, M10 × 1.5 × 40 mm LG |
| 13c | 6 | SA 193 B7 | Plug, Interseal Test Port |
| 50 | 5 | SA 193 B7 | SHCS, M36 × 4.0 × 150 mm LG |
| 30 | 4 | SA 203E | Shell, Containment |
| 14 | 4 | SA 350 | Lid, Primary |
| 13 | 4 | SA 350 | Lid, Secondary |
| 12 | 4 | SA 350 LF3 | Forging, Bottom |
| 11 | 4 | SA 350 LF3 | Forging, Upper |
| 44 | 4 | SA 564 630 H1100 | Trunnion, Lifting |
| 83 | 8 | Stainless Steel | Block, Primary Lid Vent/Drain |
| 85 | 8 | Stainless Steel | Plate, Port Cover |
| 84 | 8 | Stainless Steel | Coupling, Double Shut-Off Quick Disconnect |
| 55 | 6 | Stainless Steel | Plain Washer, 36 mm Narrow |
| 86 | 8 | Stainless Steel | Block, Secondary Lid Vent |
| 87 | 8 | Bronze, (Alloy 316) | Nut, Drain Line Seal |
| 32 | 3 | Lead | Shielding, Lead Gamma |
| 22 | 3 | Holtite-B | Shielding, Neutron |

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. A thermally conductive cask comprising:

a cylindrical body comprising:

an inner shell forming a cavity for receiving high level radioactive waste and having a longitudinal axis;

an intermediate shell comprising an inner layer and an outer layer clad to the inner layer, the inner layer constructed of a first material having a first thermal conductivity and the outer layer constructed of a second material having a second thermal conductivity that is greater than the first thermal conductivity, the intermediate shell circumferentially surrounding the inner shell in a concentric manner so as to form a first annular gap between the inner layer of the intermediate shell and the inner shell;

a first set of radial fins located within the first annular gap and connected to the inner shell and the intermediate shell;

a gamma shielding material filling the first annular gap;

an outer shell circumferentially surrounding the intermediate shell in a concentric manner so as to form a second annular gap between the outer layer of the intermediate shell and the outer shell, the outer shell constructed of the second material;

a second set of radial fins located within the second annular gap and connected to the outer layer of the intermediate shell and the outer shell, the second set of radial fins constructed of the second material; and a neutron shielding material disposed within the second annular gap;

a lid connected to a top end of the cylindrical body and enclosing a top end of the cavity; and a base connected to a bottom end of the cylindrical body and enclosing a bottom end of the cavity.

2. The thermally conductive cask of claim 1 wherein the first set of radial fins and the inner shell are constructed of the first material.

3. The thermally conductive cask of claim 2 wherein the first material is a steel and the second material is an aluminum.

4. The thermally conductive cask of claim 1 wherein the first material is carbon steel and the second material is a soft aluminum.

5. The thermally conductive cask of claim 1 wherein the outer layer is clad to the inner layer by explosion bonding.

6. The thermally conductive cask of claim 1 wherein the outer layer and the inner layer are fixedly bonded together and in conformal contact.

7. The thermally conductive cask of claim 1 wherein the first and second sets of radial tins are circumferentially offset from one another.

8. The thermally conductive cask of claim 1 wherein the second set of fins are welded to the outer layer of the intermediate shell and to the outer shell.

9. The thermally conductive cask of claim 1 wherein an outside surface of the outer shell has a topography that increases the overall surface area as opposed to a smooth surface.

10. The thermally conductive cask of claim 9 wherein the topography comprises at least one of dimples, ridges and undulations.

11. The thermally conductive cask of claim 1 wherein the body comprises a top annular forging connected to a top edge of the inner shell and a top edge of the intermediate shell, the lid connected to the top annular forging, wherein the base is connected to a bottom edge of the inner shell and a bottom edge of the intermediate shell, and wherein the inner shell, the top annular forging and the base are constructed of the first material.

12. The thermally conductive cask of claim 1 wherein the first and second materials cannot be welded together.

13. A thermally conductive cask comprising:

a steel inner shell forming a cavity for receiving high level radioactive waste and having a longitudinal axis;

an intermediate shell comprising an inner steel layer and an outer aluminum layer clad to the inner steel layer, the intermediate shell circumferentially surrounding the inner shell in a concentric manner so as to form a first annular gap between the intermediate shell and the inner shell;

a set of steel fins located within the first annular gap and connected to the inner shell and the intermediate shell;

a gamma shielding material filling the first annular gap;

an aluminum outer shell circumferentially surrounding the intermediate shell in a concentric manner so as to form a second annular gap between the aluminum layer and the outer shell;

a set of aluminum radial fins located within the second annular gap and connected to the outer layer of the intermediate shell and the outer shell; and a neutron shielding material disposed within the second annular gap.

14. The thermally conductive cask of claim 13 wherein the aluminum layer is clad to the steel layer by explosion bonding.

15. The thermally conductive cask of claim 13 wherein the aluminum layer is fixedly bonded to and in conformal contact with the steel layer.

16. The thermally conductive cask of claim 13 further comprising a lid enclosing a top end of the cavity and a base enclosing a bottom end of the cavity.

17. The thermally conductive cask of claim 13 further comprising a fuel basket positioned within the cavity.

18. A thermally conductive cask comprising:

a gamma shielding cylindrical body forming a cavity for receiving high level radioactive waste and having an outer surface formed of a first material having a first thermal conductivity;

a neutron shielding cylindrical body surrounding the gamma shielding cylindrical body, the neutron shielding cylindrical body comprising:

a first shell forming an inner surface of the neutron shielding cylindrical body;

a second shell concentrically surrounding the first shell so that an annular gap exists between the first and second shells;

a set of connectors disposed within the annular gap and connected to the first and second shells;

a neutron absorbing material filling the annular gap; and wherein the first shell, the second shell, and the connectors are constructed of a second material having a second thermal conductivity that is greater than the first thermal conductivity; and wherein the first shell is clad to the outer surface of the gamma shielding cylindrical body.

19. The thermally conductive case of claim 18 wherein the first material and the second material are metallurgically incompatible for welding.

20. The thermally conductive cask of claim 18 wherein the first shell is fixedly bonded to and in conformal contact with the outer surface of the gamma shielding cylindrical body.

21. The thermally conductive cask of claim 18 further comprising a lid enclosing a top end of the cavity and a base enclosing a bottom end of the cavity.

22. The thermally conductive cask of claim 1 wherein one or more of the radial fins of the second set penetrate the outer shell.

23. The thermally conductive cask of claim 13 wherein one or more of the aluminum radial fins penetrate the aluminum outer shell.

24. The thermally conductive cask of claim 18 wherein one or more of the connectors penetrate the second shell.

25. A thermally conductive cask comprising:

a gamma shielding cylindrical body forming a cavity for receiving high level radioactive waste and having an outer surface formed of a first material having a first thermal conductivity;

a neutron shielding cylindrical body surrounding the gamma shielding cylindrical body and having a layer formed of a second material having a second thermal conductivity that is greater than the first thermal conductivity, the layer forming an inner surface of the neutron shielding cylindrical body wherein the layer is clad to the outer surface of the gamma shielding cylindrical body; and the neutron shielding cylindrical body comprising an outer shell formed of the second material, a set of radial fins connecting the layer and the outer shell, the set of radial fins constructed of the second material; and as neutron radiation shielding material filling an annular gap between the outer shell and the layer.

* * * * *